United States Patent [19]

Crisp

[11] 4,380,100

[45] Apr. 19, 1983

[54] SAFETY BELT BUCKLE

[75] Inventor: Terrence S. Crisp, Haasrode, Belgium

[73] Assignee: Klippan S.A., Haasrode, Belgium

[21] Appl. No.: 114,811

[22] Filed: Jan. 24, 1980

Related U.S. Application Data

[63] Continuation of Ser. No. 953,241, Oct. 20, 1978, abandoned, which is a continuation of Ser. No. 781,918, Mar. 28, 1977, abandoned.

[30] Foreign Application Priority Data

Nov. 9, 1976 [DE] Fed. Rep. of Germany ..... 2651115

[51] Int. Cl.[3] ..... A44B 11/26

[52] U.S. Cl. ..... 24/230 AL

[58] Field of Search ..... 24/230 A, 230 AL, 230 AP, 24/230 AK

[56] References Cited

U.S. PATENT DOCUMENTS

| | | | |
|---|---|---|---|
| 3,355,781 | 12/1967 | Silberschlag | 24/230 A |
| 3,399,431 | 9/1968 | Shanklin et al. | 24/230 AK |
| 3,895,196 | 7/1975 | Lewis | 24/230 A |
| 3,921,262 | 11/1975 | Tanaka | 24/230 A |
| 4,065,836 | 1/1978 | Stephenson | 24/230 A |
| 4,068,354 | 1/1978 | Loomra et al. | 24/230 A |
| 4,069,557 | 1/1978 | Loomba | 24/230 AL |

*Primary Examiner*—Kenneth Dorner

*Attorney, Agent, or Firm*—Roger H. Criss

[57] ABSTRACT

A safety belt buckle is provided with plural locking features that increase its holding strength and decrease fastening and release effort. The buckle has a housing containing means for receiving the tongue of a seat belt. A latching means is rotated into engagement with the tongue by a cam means associated therewith. The latching means cooperates with a locking means to hold it within the housing. The buckle is small, light, strong, reliable, easy to fasten and unfasten, comfortable to wear and inexpensive to produce.

4 Claims, 5 Drawing Figures

SAFETY BELT BUCKLE

This is a continuation of application Ser. No. 953,241, filed Oct. 20, 1978, now abandoned which is a continuation of U.S. Ser. No. 781,918, filed Mar. 28, 1977, now abandoned.

BACKGROUND OF THE INVENTION

The invention concerns a lock for safety belts, particularly in motor vehicles, with a housing and a fastening device for fastening the housing on the vehicle at an anchoring point. With these safety belts the passengers are protected against accidents.

DESCRIPTION OF THE PRIOR ART

Safety belts have been developed to reduce the number of fatal accidents and serious injuries which result from accidents with motor vehicles. Most of these locks have as main parts a housing which is arranged on a belt strap or on a fastening clamp anchored on the vehicle, and a latching mechanism which cooperates with the tongue of another belt strap, which is likewise secured on the vehicle in a similar manner. One of the problems appearing in these belt locks is the difficulty of introducing the tongue into the housing and bringing it out of the housing. The strenuous and hard introduction is caused by a prestressing force which is exerted on the latching means during the insertion of the tongue and this strenuous insertion prevents the passengers from using the safety belts at all, or it leads to the assumption that their belt is already fastened, while it is actually not locked at all. Another problem appearing in connection with these belt locks is the difficulty of preventing premature ejection of the tongue at the time of the accident. A disadvantage of the known belt locks is also their relatively large size, their weight and their price.

The object of the invention is therefore to provide means for overcoming the above mentioned problems and to improve particularly devices for accommodating and facilitating the operation of the parts of the lock.

SUMMARY OF THE INVENTION

According to the invention a safety belt lock is provided which is compact, light-weight and firm and which has features which eliminate the difficulties such as strenuous insertion, false latching, premature ejection etc. The lock according to the invention has a housing with an opening provided therein and a cavity which extends from the opening to a housing wall opposite the latter. An inlet means is provided for attaching the housing at an anchoring point on the vehicle. The lock has a latch for engagement of the safety belt tongue. A locking part, which can consist of several parts, is mounted slidingly on the housing for locking engagement with the latch. The latch is provided with a cam by means of which the latch can be brought in engagement with the tongue. A prestressing means connected with the housing tightens the locking device with the latch in locking engagement. A release means is slidingly mounted on the housing to move the locking device out of engagement with the latch.

The safety belt of this invention has a very advantageous design. A unique cooperation between locking device cam and latch reduces the size of the forces acting against these means, particularly the latch expended during the time of the accident of the vehicle, or reduces their effect. The prestressing force, which is exerted by spring-actuated locks on the latching mechanism, is eliminated, the strenuous and hard entrance and false latching in the cavity of the housing are eliminated, and the disengaging force is reduced. The lock holding forces are increased, while the size and weight of the lock belt are reduced. Consequently safety belt locks according to the invention are cheaper to produce, easier to fasten, are more comfortable to wear, and provide better protection for passengers than it was the case with the presently known locks.

BRIEF DESCRIPTION OF THE DRAWINGS

Other advantageous features and possible applications of the present invention will result from the following description in connection with the drawings.

DESCRIPTION OF THE PREFERRED EMBODIMENTS

Figure 1:
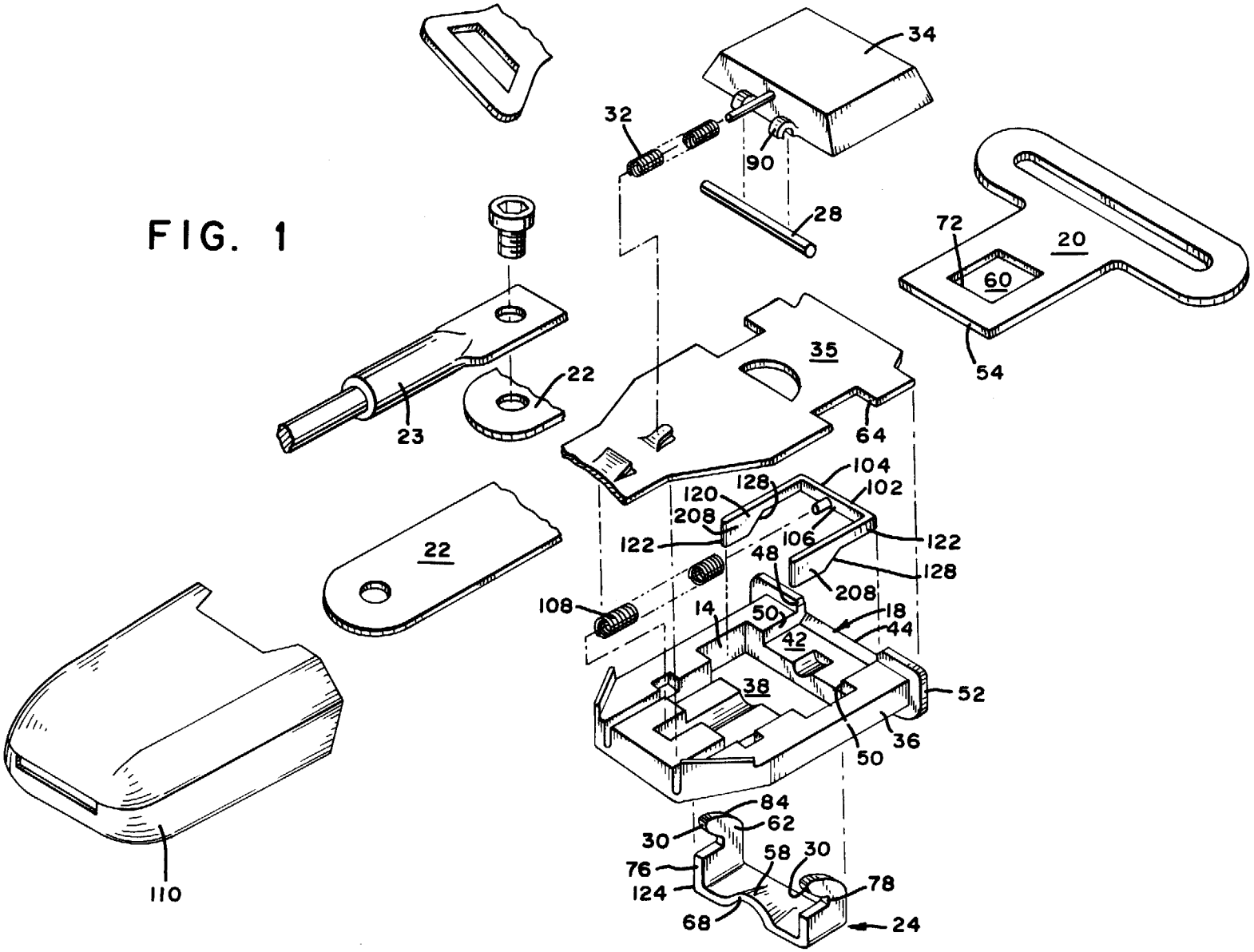
FIG. 1 shows an exploded view of the safety belt lock according to the invention.

The locking according to the invention has a housing, generally designated with 10, in which is provided at the bottom an opening 12 from which a cavity 14 extends to a wall of housing 10 opposite opening 12. The housing has an inlet means 18 which is in connection with cavity 14 to receive tongue 20 of a safety belt. The housing is secured on the vehicle over a connecting means 22 and a fastening element 23, a belt strap part (not shown) and an anchoring point (likewise not shown). A latch means, which is shown in this preferred embodiment as a latch 24, is provided to engage belt strap tongue 20. A locking mechanism lock bar, etc. shown in this embodiment as a locking pin, is secured on housing 10 for locking engagement with latch 24. Latch 24 is provided with a cam surface 30 by means of which latch 24 can be brought an engagement with tongue 20. A prestressing means 32, shown here as a pushbutton spring, is secured on housing 10 and prestressed locking pin 28, which can also be designed as a web, is capable of locking engagement with latch 24. On housing 10 is also secured a release means designed as pushbutton 34. Pushbutton 34 moves locking pin 28 out of engagement with latch 34.

Housing 10 is preferably composed of a plurality of plates. According to FIG. 1, an opening 38 is provided in the center part of upper plate 35, which can also be called a fixing strap, and bottom plate 36. Bottom plate 36 has a channel 42 which extends from one edge 44 of plate 36 into the center part of the plate, this channel 42 forming a part of the inlet means 18. Bottom plate 36 has a guide means, which can consist, for example of spaced parallel walls 50 and which extends from the interior of cavity 14, to an end point 48 on the outer surface of housing 10 to guide tongue 20 into cavity 14 of housing 10.

The number of laminated or layered plates used varies with the depth of the cavity and the type of plate material. In a special embodiment, upper plate 35 is pressed, embossed or stamped from a metal such as steel aluminum etc. and bottom plate 36 is produced by injection-molding or in any other way of polymer material. Suitable polymer materials are thermoplastic resins, such as acetate homopolymer or copolymer or polycarbonate, as well as thermosetting resins, such as phenol resins. Preferably housing 10 consists of two plates, namely upper plate 35 and bottom plate 36. These plates can be produced very cheaply using conventional machines.

Housing 10 is mounted by joining bottom plate 36 and upper plate 25 in sandwich fashion and securing the joined plates by mechanical fastening means, such as rivets, etc. On the other hand, the plates can also be joined with each other by spot welding or cementing, in which case suitable epoxy resins etc. are used. After mounting the plates for the formation of an integral laminated or layered housing unit, the above mentioned guide means is formed by spaced parallel walls 50 and a bell-shaped extension 52 which contains bottom plate 36. Walls 50 and extension 52 cooperate with the front end 54 of tongue 20 in such a way that a smooth entrance of tongue 20 into cavity 14 is ensured.

Figure 2:
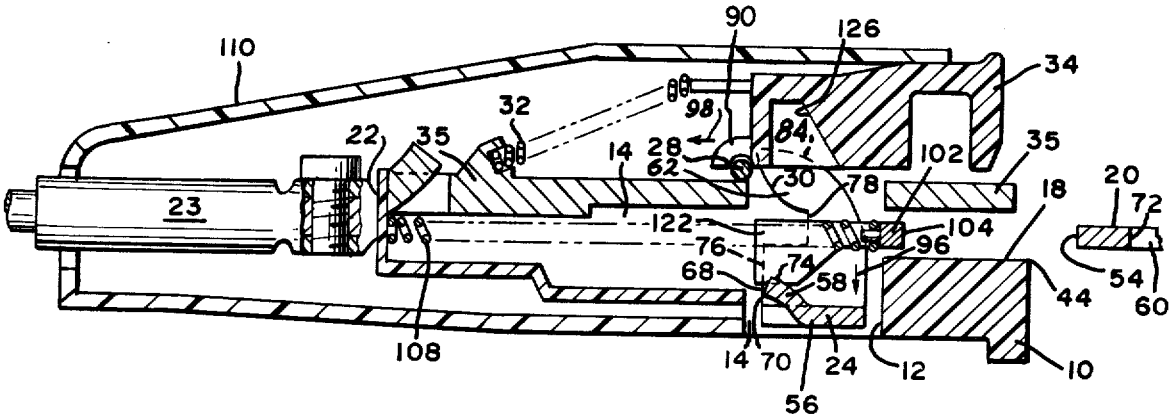
FIGS. 2 and 3 show sectional views of the lock according to FIG. 1 illustrating the various positions of the latch means, of the cam means of the locking means and of the housing.
Figure 3:
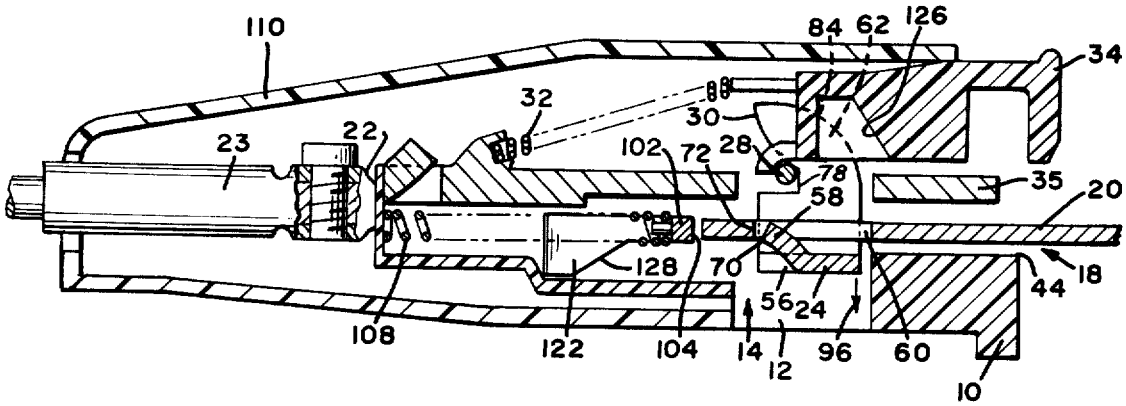
Figure 4:
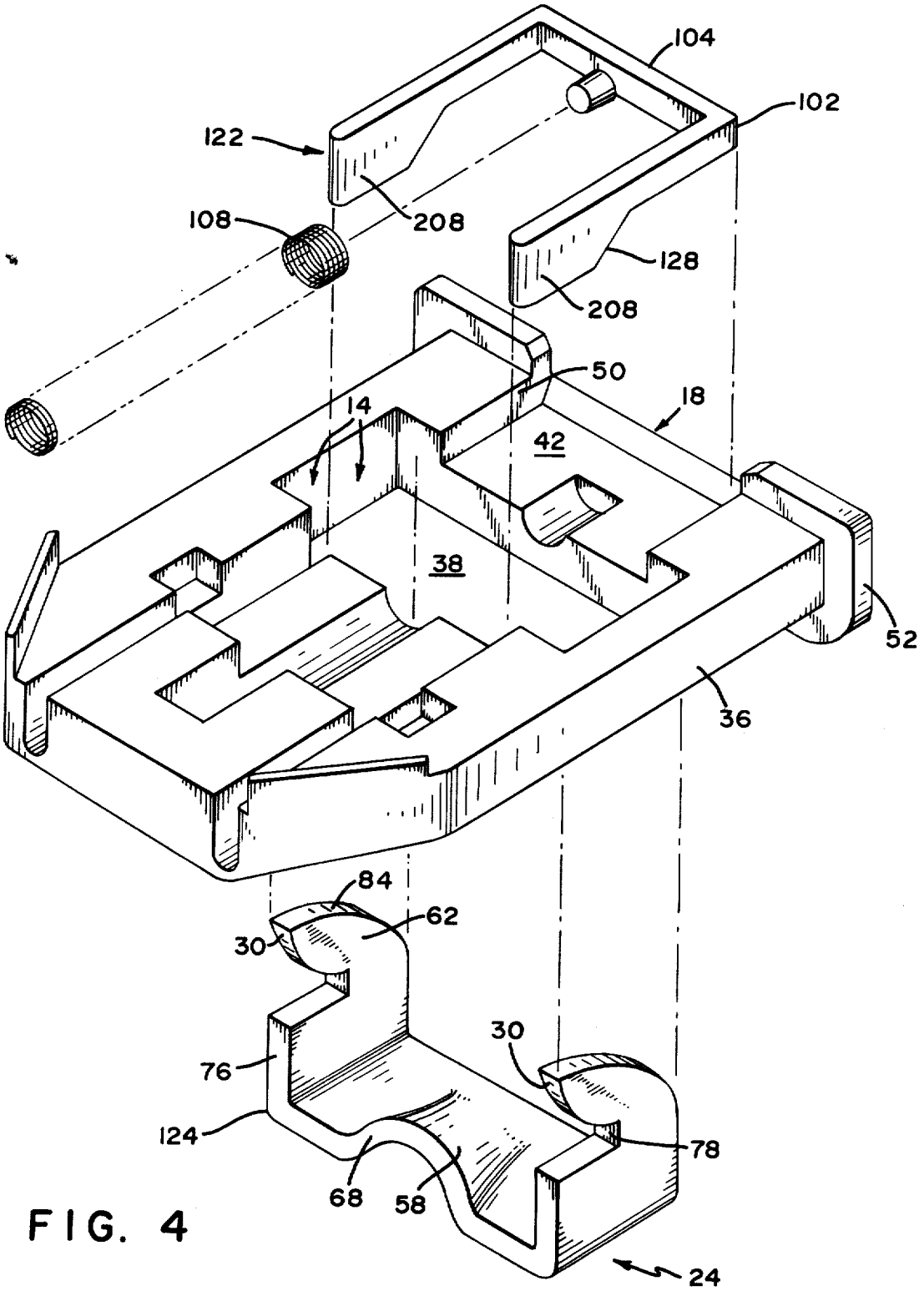
FIG. 4 shows an enlarged view of the latch and of bottom plate of the housing of an ejector spring and of an ejector means, on a larger scale than shown in the exploded view in FIG. 1.

We refer now to FIGS. 2 to 4, in which latch 24, cam part 36 and locking part 28 are shown in their position relative to housing 10. Latch 24 can be designed as a web, for example, with a raised portion 58 fitting into opening 60 of tongue 20. The fitting end 68 of latch 24 is beveled or inclined in the representation of the embodiment according to FIGS. 2 and 3. In this embodiment, the fitting end 68 has particularly a bottom edge 70 which can engage the fitting wall 72 of tongue 20, and upper plate 74 is inclined away from this wall 72, the angle of inclination from wall 72 being about 3.0 to 30.0 deg. Latch 24 has several shoulders 62, in the represented embodiment according to FIGS. 1 and 4, two which move in passage 64 of upper plate 35 shown in FIG. 1. Rear portions 30 of shoulders 62 extend into the passages 64 and provide a smooth continuous surface which cooperates with locking part 28 designed as a pin, as it will be described below. Each shoulder 62 has furthermore a rear face 76 with a recess or notch 78. The cam means or cam surface 30 extends from notch 78 upward to the top side of each shoulder 62, and cam surface 30 has a curved form. The angle of curvature of cam surface 30 can vary, depending on the shape of locking pin 28, the weight of latch 24 and the extent of its upward movement. In general, the angle of curvature of cam surface 30 is about −10 to 90 deg., and preferably −10 to 45 deg.

Locking pin 28 is suitably designed to fit into notch 78 of each shoulder 62. In the represented embodiment, locking part 28 is designed as a pin, but it is also conceivable that it can be designed in other embodiments as a bar, web, small band etc. The locking pin 28 moves in the preferred embodiment described here together with cam surface 30 of latch 24 and exerts on the latter an upward force during its movement to notch 78.

Pushbutton 34 shown in FIGS. 1 to 3 is a release mechanism which can be designed for example, as a hoop, web or bar. The pushbutton has a first part 90 for engagement with locking pin 28, and a second cam means, which can be a ramp 126, for example, in the embodiment described here, and can be arranged slidingly on housing 10 to move latch 24 out of engagement with tongue 20. Preferably the belt lock has an ejector part 122 for ejecting tongue 20 from housing 10, and another cam means is provided in the form of several ramps 128 which are arranged on ejector part 122 for sliding engagement with bottom part 124 of latch 24. As mentioned above, pushbutton 34 acting as release mechanism can be provided with the second cam means in the form of ramps 126 which are suitably designed to engage the front face 84 of each shoulder 62 of latch 24. Latch 24, locking pin 28, and pushbutton 34 are arranged in cavity 14, where at least parts thereof are arranged in overlapping position in the direction in which cavity 14 extends in housing 10. Preferably a cover 110 is arranged around housing 10. Cover 110 has a single part of light plastic etc., it does not contribute markedly to the strength or weight of the arrangement but protects mainly the parts arranged therein against contamination and possible damage by manipulations.

In operation, that is, in use, tongue 20 is inserted into inlet 18 and cavity 14, the opening 60 coming to lie over the raised portion 58 of latch 24. Cam surface 30 is urged forward by spring 32 which moves the raised portion 58 into engagement with opening 50 of tongue 20. At the same time locking pin 28 engages notch 78 of latch 24 and locks tongue 20 in housing 10. Due to the bevel of the fitting end 68 of latch 24 relative to wall 72 of tongue 20 fitting with the latter, tensile forces, which have been expended toward the tongue at the time of an accident, are transmitted partly to locking pin 28. The latter holds together with latch 24 in such a way that it holds tongue 20 safely in housing 10. The movement of pushbutton 34 toward locking pin 28 forces latch 24 in wedge- or cam-fashion downward or brings in an alternate embodiment of the invention the ramp means 126 in contact with the front face 84 of the shoulders 62, latch 24 moving in the direction of arrow 96 (FIGS. 2 and 3).

At the same time locking pin 28 is displaced in the direction of arrow 98 opposite to the initial stress of spring 32 until locking pin 28 is brought out of notch 78. By pressing down latch 24, the raised portion 58 is brought under opening 60 of tongue 20, with the result that tongue 20 can be removed freely from housing 10. In order to further facilitate the removal of tongue 20 from housing 10, the lock can be provided, as mentioned above, with an ejector part 122 which has an ejector slide 102 with a front edge 104 which is suitably designed to engage the front end 54 of tongue 20 and the rear edge 106 secured on a prestressing means 108 designed, for example, as a spring. Ejector spring 108 consists in some special embodiments of three springs; though it is conceivable that two, four or more springs can be used as ejector springs, in a special embodiment ejector spring 108 has a greater force than spring 32 on pushbutton 34. This way, when the tongue does not lock properly, e.g. if pushbutton 34 is not forced by spring 32 by friction clamping, etc. out of the position shown in FIG. 2, tongue 20 is immediately ejected so that the user knows his belt strap system is not properly locked.

The prestressing means 108 exerts a prestressing force on ejector slide 102 which bears against the front end 54 of tongue 20 to retain tongue 20 in housing 10 and to force it out of housing 10 after pushbutton 34 has been pressed. In addition, ejector slide 102 can have (1) several lugs 208 which prevent the upward movement of latch 24 until slide 102 has been displaced to the rear by the front end 54 of tongue 20, and (2) several ramps 128 which push latch 24 down upon actuation of pushbutton 34.

Figure 5:
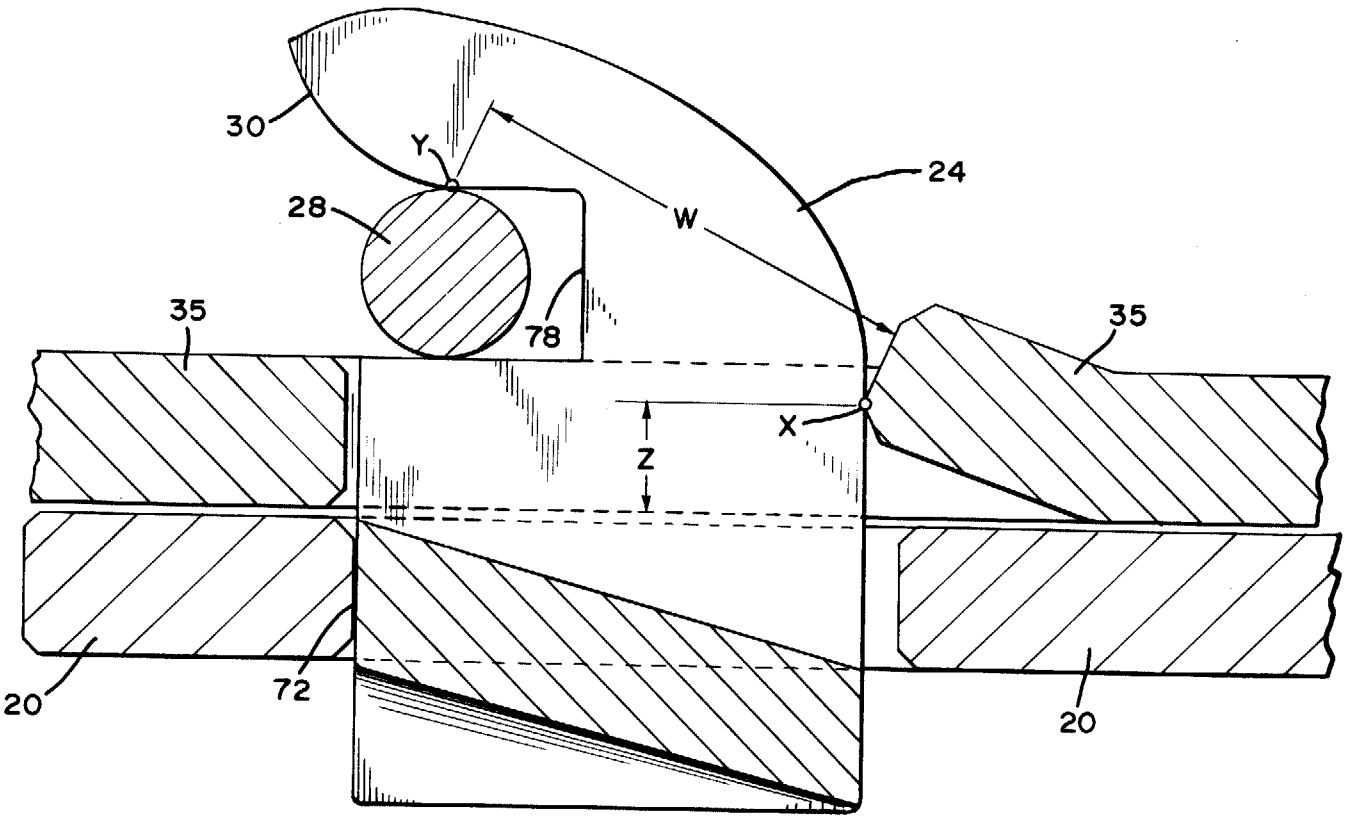
FIG. 5 shows schematically in a special embodiment the latch, a locking part designed as a pin with a tongue arranged in a position shown in broken lines and with an upper housing part.

On the basis of the embodiment in FIG. 5, the operation of the lock can also be described alternately in the three following cases, which can be so defined that the tongue is received and held in place, preventing disengagement even under high load, while easy disengagement is possible under medium load by unbuckling.

In the first case, tongue 20 is inserted and strikes against ejector part 122, which compresses ejector spring 108 until ejector part 122 has reached a position comparable to that in FIG. 3. When the ejector part has reached this position, there is no obstruction or barrier to hold latch 24 in unlocked position. Locking pin 28 transmits the spring force from pushbutton spring 32 to the upper shoulders 62 of latch 24 by striking against cam surface 30 and running down on the latter. Latch 24 rises thus into engagement position, as it is known from FIG. 3, for example, and pushbutton 34 has an opportunity to move the assembly with locking pin 28 into the forward position, which can likewise be seen from FIG. 3. In this position, removal of the force from tongue 2 causes ejector spring 108 to exert over ejector part 122 a force on latch 24 on its locking face 76 with tongue 20, so that the latch turns counterclockwise about a point designated with X on the round surface 84 on the upper plate or fastening point 36 until locking is achieved by locking pin 28, so that tongue 20 is again held securely. This is shown approximately in FIG. 5.

In the second case for example, if a high tensile load is exerted on the belt lock, the resulting force is transmitted from tongue 20 over latch 24 to the fastening point 35. With poor alignment of the loading points between these areas, a coupling is obtained which tends to turn latch 24 counterclockwise. This results again in locking against locking pin 28, and unlocking is thus not possible. Pulling the strap belt secured on the tongue apart or from the lock is only possible at the time of accident in this preferred and advantageously designed embodiment if the loaded parts, e.g. the web between surface 72 and the front end of 54 of tongue 20 breaks.

For the third case we will discuss the opening of the lock. By pressing down pushbutton 34, locking pin 28 is pushed to the rear against the force of spring 32, so that locking pin 28 is disengaged from latch 24. Due to the load of tongue 20, either by ejector spring 108 or any additional pull on the tongue, a torque is produced about the tipping point X and the unheld latch 24 is brought out of its locking positions so that tongue 20 can be ejected. When tongue 20 is ejected, the ejector part 122 moves forward under the action of ejector spring 108, that is, toward inlet 18. The two lugs 208 on ejector part 122 touch the depressed latch 24 and hold it in this depressed position. Latch 24 in turn holds locking pin 28, and pushbutton 34 is thus in its depressed position as shown, for example, in FIG. 2.

The lock according to the invention can be mounted during the manufacture with two hands without the necessity of using tools or fastening devices, such as a vise etc. and the mounting of the belt lock can be effected without turning the latter.

Some critical measurements have a great tolerance, that is, the rotary locking of the latch makes the measurements of the shoulder 62 of latch 24 uncritical.

The spring force between pushbutton spring 32 and ejector spring 108 is so balanced that locking pin 28 is forced out from partial engagement in wedge- or cam-fashion, due to the torque reaction by ejector spring 108, if the inserting force no longer exists and if locking pin 28 is not in engagement, so that "false locking" is in any case prevented. The effort or force for disengaging the lock depends on the torque (distance Z in FIG. 5) between point X and the effective locking level of tongue 20 on latch 24 (which controls the torque on latch 24) and on the distance W between point X and point Y where latch 24 touches locking pin 28, so that an extremely low release force is provided. These advantages can be seen particularly clearly from FIG. 5. A wrong function of the lock, where locking pin 28 is not brought in full engagement, for example, leads to a state where tongue 20 is ejected immediately after it has been inserted.

I claim:

1. A seat belt buckle comprising:

an inlet slot for receiving a tongue;

a latch movable between lock and unlock positions, said latch including a latching surface for engagement with said tongue when said latch is in its lock position whereby said tongue is retained in said buckle, said latch including a lock bar receiving surface, said latch normally being disposed in its unlock position;

a push button slidably disposed in said buckle;

a push button spring biasing said push button to a forward position, said push button being movable against the bias of said spring to a rearward position at which said latch is moved to its unlock position to release said tongue;

a lock bar slidably movable with said push button, said lock bar normally being spaced from said lock bar receiving surface of said latch, said lock bar being movable into engagement with said lock bar receiving surface of said latch upon insertion of said tongue into said buckle and movement of said latch to its lock position to retain said latch in said lock position, said lock bar being movable out of engagement with said lock bar receiving surface upon movement of said push button to its rearward position to release said latch from its lock position; and an ejection bar for ejecting said tongue from said buckle when said push button is moved to its rearward position; said latch comprising cam means engagable by said lock bar, said cam means comprising an upstanding element having a curved underside surface adjacent a slot, said slot defining said lock bar receiving surface, said lock bar being movable along said underside surface to move said latch into its lock position, and said lock bar being further movable along said underside surface into said slot, whereby said latch is retained in its lock position.

2. The buckle of claim 1 wherein said ejection bar includes means normally retaining said latch in its unlock position, said ejection bar being movable upon insertion of said tongue to release said latch for movement to its lock position.

3. The buckle of claim 2 wherein said lock bar is movable due to the bias of said push button spring to move said latch into its lock position upon insertion of said tongue into said buckle.

4. A seat belt buckle comprising:

an inlet slot for receiving a tongue;

a latch movable between lock and unlock positions, said latch including a latching surface for engagement with said tongue when said latch is in its lock position whereby said tongue is retained in said buckle, said latch including a lock bar receiving surface, said latch normally being disposed in its unlock position;

a push button slidably disposed in said buckle;

a push button spring biasing said push button to a forward position, said push button being movable against the bias of said spring to a rearward position at which said latch is moved to its unlock position to release said tongue;

a lock bar slidably movable with said push button, said lock bar normally being spaced from said lock bar receiving surface of said latch, said lock bar being movable into engagement with said lock bar receiving surface of said latch upon insertion of said tongue into said buckle and movement of said latch to its lock position to retain said latch in said lock position, said lock bar being movable out of engagement with said lock bar receiving surface upon movement of said push button to its rearward position to release said latch from its lock position; and an ejection bar for ejecting said tongue from said buckle when said push button is moved to its rearward position; said latch being movable into its lock position upon movement of said lock bar towards its engagement with said lock bar receiving surface of said latch.

* * * * *